US009097412B1

(12) United States Patent
Pinato

(10) Patent No.: US 9,097,412 B1
(45) Date of Patent: Aug. 4, 2015

(54) LED LIGHTBULB HAVING A HEAT SINK WITH A PLURALITY OF THERMAL MOUNTS EACH HAVING TWO LED ELEMENT TO EMIT AN EVEN LIGHT DISTRIBUTION

(71) Applicant: Robert M. Pinato, Sunapee, NH (US)

(72) Inventor: Robert M. Pinato, Sunapee, NH (US)

( * ) Notice: Subject to any disclaimer, the term of this patent is extended or adjusted under 35 U.S.C. 154(b) by 187 days.

(21) Appl. No.: 13/870,208

(22) Filed: Apr. 25, 2013

Related U.S. Application Data

(60) Provisional application No. 61/782,844, filed on Mar. 14, 2013, provisional application No. 61/729,009, filed on Nov. 21, 202.

(51) Int. Cl.

| | |
|---|---|
| ***F21V 21/00*** | (2006.01) |
| ***F21V 29/00*** | (2015.01) |
| ***F21K 99/00*** | (2010.01) |
| *F21Y 101/02* | (2006.01) |

(52) U.S. Cl.
CPC ..... *F21V 21/00* (2013.01); *F21K 9/135* (2013.01); *F21V 29/004* (2013.01); *F21V 29/22* (2013.01); *F21Y 2101/02* (2013.01)

(58) Field of Classification Search
CPC ..... F21K 9/135; F21K 9/10; F21K 9/13; F21V 29/004; F21Y 2101/02
USPC ..... 362/249.02, 294, 373, 218
See application file for complete search history.

(56) References Cited

U.S. PATENT DOCUMENTS

| | | | | |
|---|---|---|---|---|
| 3,978,332 | A | 8/1976 | Goytisolo Taltavull | 240/51.11 |
| 4,161,014 | A | 7/1979 | Dey et al. | 362/263 |
| 4,161,015 | A | 7/1979 | Dey et al. | 362/263 |
| 5,668,042 | A | 9/1997 | Bae | 438/18 |
| 5,899,557 | A | 5/1999 | McDermott | 362/244 |
| 5,971,551 | A | 10/1999 | Winston et al. | 359/868 |
| 6,573,536 | B1 | 6/2003 | Dry | 257/88 |
| 6,634,770 | B2 | 10/2003 | Cao | 362/294 |
| 6,793,374 | B2 | 9/2004 | Begemann | 362/294 |
| 6,837,605 | B2 | 1/2005 | Reill | 362/555 |
| 6,905,228 | B1 | 6/2005 | Takeyasu et al. | 362/249 |
| 7,049,746 | B2 | 5/2006 | Mano et al. | 313/512 |
| 7,273,299 | B2 | 9/2007 | Parkyn et al. | 362/244 |
| 7,387,403 | B2 | 6/2008 | Mighetto | 362/218 |
| 7,434,964 | B1 | 10/2008 | Zheng et al. | 362/294 |
| 7,524,089 | B2 | 4/2009 | Park | 362/294 |
| 7,534,015 | B2 | 5/2009 | Xu et al. | 362/373 |
| 7,563,005 | B2 | 7/2009 | Yatsuda et al. | 362/373 |
| 7,658,510 | B2 | 2/2010 | Russell | 362/249.02 |
| 7,731,395 | B2 | 6/2010 | Parkyn et al. | 362/335 |
| 8,382,331 | B2 * | 2/2013 | Cheng | 362/294 |
| 8,414,153 | B2 * | 4/2013 | Barta | 362/249.02 |
| 8,641,237 | B2 * | 2/2014 | Chuang | 362/294 |
| 8,702,257 | B2 * | 4/2014 | Lenk et al. | 362/84 |
| 2002/0005826 | A1 | 1/2002 | Pederson | 345/82 |
| 2002/0021573 | A1 | 2/2002 | Zhang | 362/555 |
| 2003/0189832 | A1 | 10/2003 | Rizkin et al. | 362/302 |

(Continued)

*Primary Examiner* — Robert May

(74) *Attorney, Agent, or Firm* — Christopher P. Maiorana, PC

(57) ABSTRACT

An apparatus comprising a base, a heat sink, a plurality of thermal elements, and a plurality of LED elements. The base may be configured to attach to a screw in light socket. The heat sink may be connected to the base. The plurality of thermal mounts may project from the heat sink. The thermal mounts may be electrically connected to the base and thermally connected to the heat sink. The plurality of LED elements may be connected to the thermal mounts. The LED elements may form a pattern about a central axis to project light evenly from the apparatus.

13 Claims, 8 Drawing Sheets

(56) References Cited

U.S. PATENT DOCUMENTS

| | | | | |
|---|---|---|---|---|
| 2006/0262424 | A1 | 11/2006 | Choi | 359/707 |
| 2007/0025109 | A1 | 2/2007 | Yu | 362/362 |
| 2007/0058369 | A1 | 3/2007 | Parkyn et al. | 362/235 |
| 2008/0291663 | A1 | 11/2008 | Wedell et al. | 362/147 |
| 2008/0316755 | A1 | 12/2008 | Zheng et al. | 362/373 |
| 2009/0045933 | A1 | 2/2009 | Smith et al. | 340/468 |
| 2009/0059559 | A1 | 3/2009 | Pabst et al. | 362/84 |
| 2009/0195186 | A1 | 8/2009 | Guest et al. | 315/294 |
| 2009/0323325 | A1 | 12/2009 | Long et al. | 362/234 |
| 2012/0069570 | A1* | 3/2012 | Marinus et al. | 362/249.02 |

* cited by examiner

LED LIGHTBULB HAVING A HEAT SINK WITH A PLURALITY OF THERMAL MOUNTS EACH HAVING TWO LED ELEMENT TO EMIT AN EVEN LIGHT DISTRIBUTION

This application relates to U.S. Provisional Application No. 61/782,844, filed Mar. 14, 2013 and U.S. Provisional Application No. 61/729,009, filed Nov. 21, 2012, each of which are hereby incorporated by reference in their entirety.

FIELD OF THE INVENTION

The present invention relates to lighting in general and, more particularly, to a method and/or architecture for implementing an LED lightbulb with a full light dispersion.

BACKGROUND OF THE INVENTION

Conventional incandescent light bulbs provide an even distribution of light. However, conventional incandescent light bulbs are inefficient when it comes to power consumption. Modern technologies, such as compact fluorescent bulbs (CFL) and light emitting diode (LED) bulbs improve the overall power efficiency. However, such designs tend to be aesthetically less pleasing than a conventional incandescent bulb.

It would be desirable to implement a LED lightbulb that has similar size and/or shape compared with a conventional incandescent bulb.

SUMMARY OF THE INVENTION

The present invention concerns an apparatus comprising a base, a heat sink, a plurality of thermal elements, and a plurality of LED elements. The base may be configured to attach to a screw in light socket. The heat sink may be connected to the base. The plurality of thermal mounts may project from the heat sink. The thermal mounts may be electrically connected to the base and thermally connected to the heat sink. The plurality of LED elements may be connected to the thermal mounts. The LED elements may form a pattern about a central axis to project light evenly from the apparatus.

The objects, features and advantages of the present invention include providing an LED lightbulb that may (i) have a similar size and/or shape compared with a conventional bulb, (ii) minimize the number of LED elements, (iii) provide a variety of light output configurations, (iv) provide a heat dissipating base, (v) provide a long lasting bulb and/or (vi) provide an energy efficient bulb.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
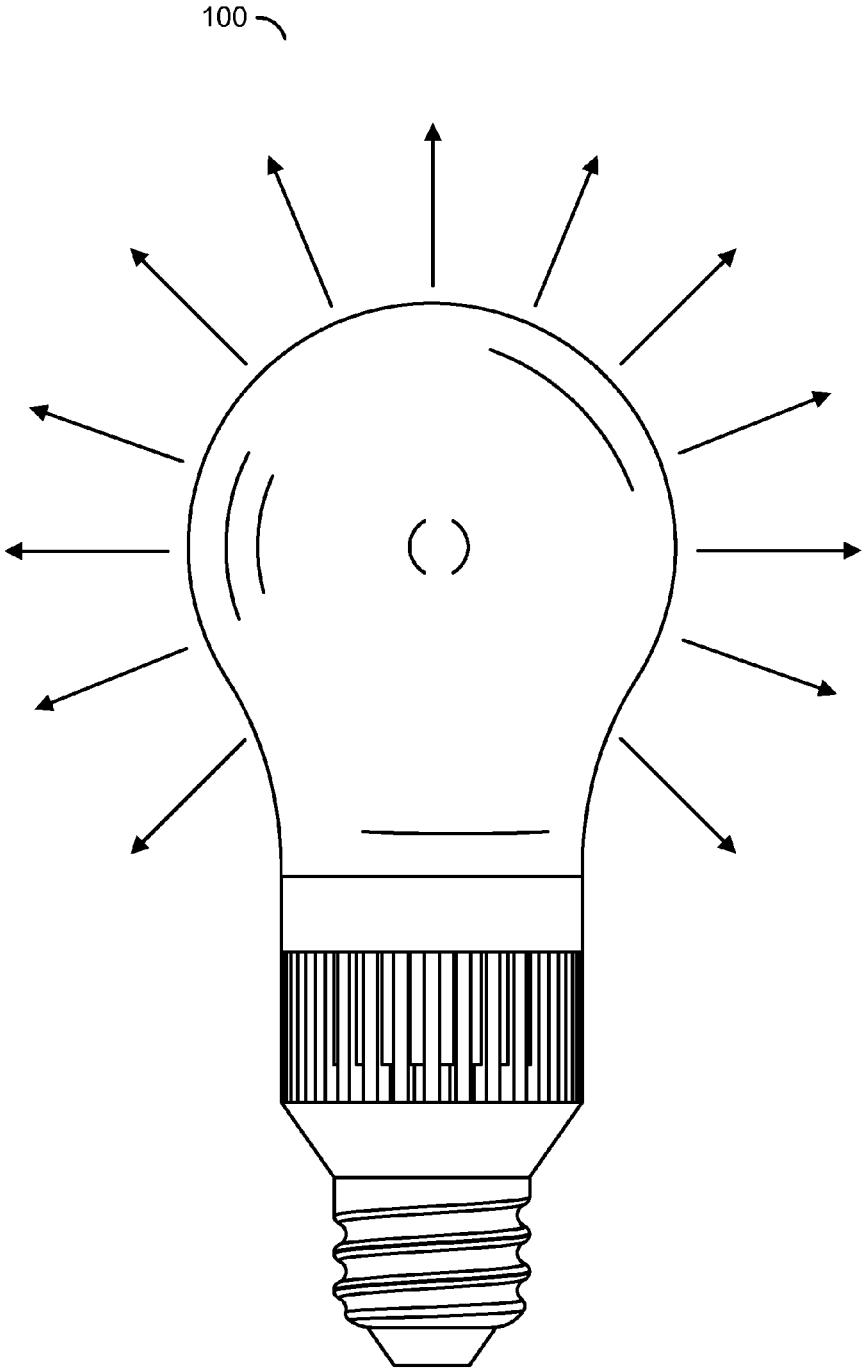
FIG. 1 is a diagram of an LED bulb.

Referring to FIG. 1, a block diagram of a bulb 100 is shown in accordance with a preferred embodiment of the present invention. The bulb 100 may mount a number of LED elements to provide a uniform light distribution. The particular mounting may allow, in one example, a 290 degree light projection. The particular light projection pattern may be varied to meet the design criteria of a particular implementation. The bulb 100 may provide a unique feel of a centered light source (similar to old fashion incandescent lights) and/or provide a more uniform distribution of light.

The bulb 100 may be used in a variety of designs, such as lamps, ceiling fixtures, recessed lights, outdoor lights, etc. The bulb 100 may minimize the number of LED elements needed, while providing uniform light. In one example, 290 degrees of light may be projected. The bulb 100 may be used in the same manner as existing lights. With the LED energy efficiency of LED elements, a green experience may be implemented.

Figure 2:
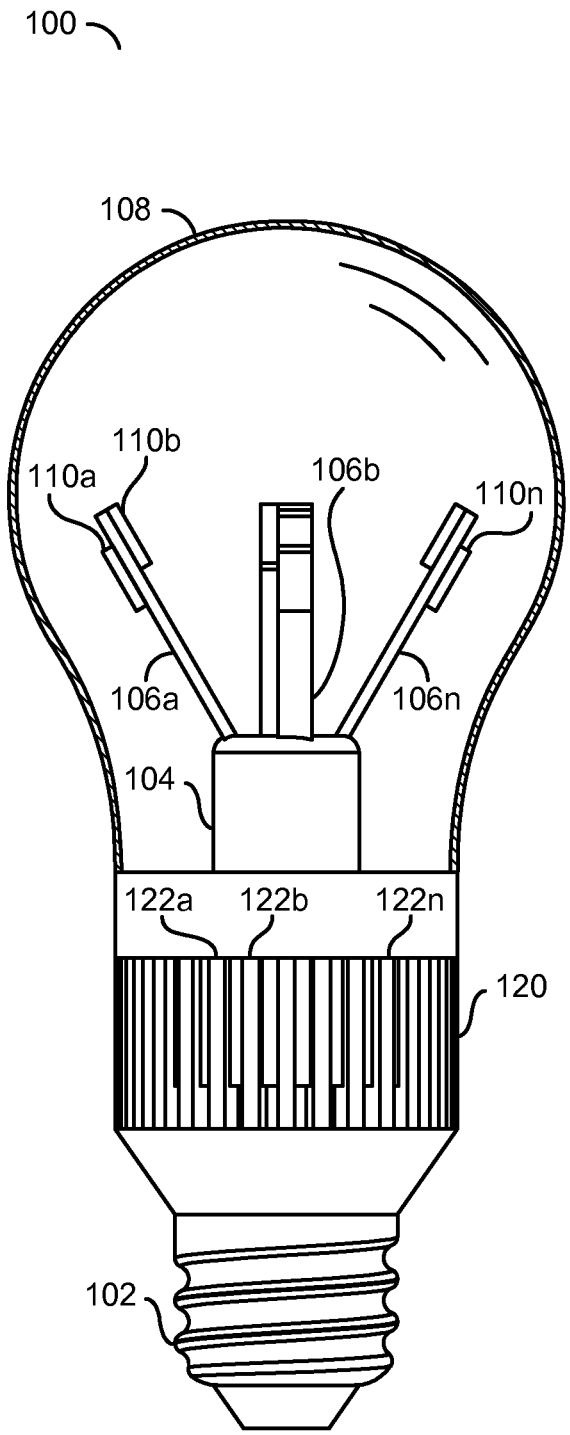
FIG. 2 is a diagram of an LED bulb showing a number of internal elements.

Referring to FIG. 2, a more detailed diagram of the bulb 100 is shown. The bulb 100 generally comprises a base 102, a heat sink 104, a plurality of thermal mounts 106*a*-106*n*, an outer housing 108 and a plurality of elements 110*a*-110*n*. The elements 110*a*-110*n* may be implemented as light elements, such as LED light elements. Each of the thermal mounts 106*a*-106*n* may hold one or more of the elements 110*a*-110*n*. For example, the thermal mount 106*a* is shown having an element 110*a* on one side and an element 110*b* on the second side. The thermal mounts 106*a*-106*n* may be arranged inside the bulb 100 in a variety of configurations (to be described in more detail in connection with FIGS. 3-15).

The outer housing 108 and/or the heat sink 104 may be connected to a finned base 120. The finned base 120 may have a number of slots 122*a*-122*n*. The slots may allow air to flow over the heat sink 104 to provide passive cooling to the elements 110*a*-110*n*.

Figure 3:
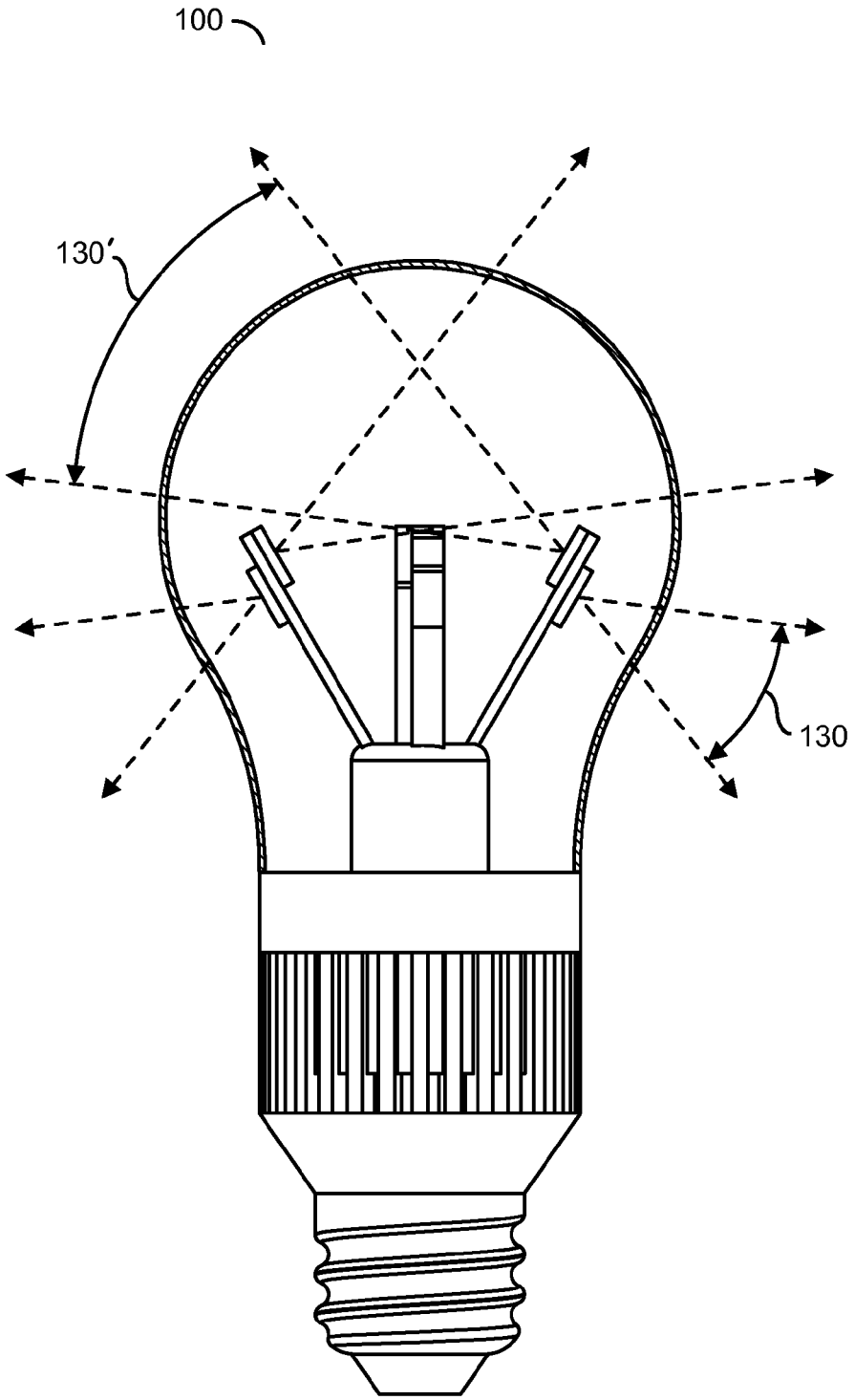
FIG. 3 is a diagram of an LED bulb showing a light distribution pattern from the individual elements of FIG. 2.

Referring to FIG. 3, a diagram of the bulb 100 is shown. An angle 130 and an angle 130' are shown. In general, each of the elements 110*a*-110*n* may provide a light dispersion of approximately 45 degrees. In general, the particular type of the light elements 110*a*-110*n* used may be varied to meet the same criteria of a particular implementation. If the particular type of light elements 110*a*-110*n* has a wider range of light than the angle 130, the bulb 100 may still enhance the ultimate lighting experience.

Figure 4:
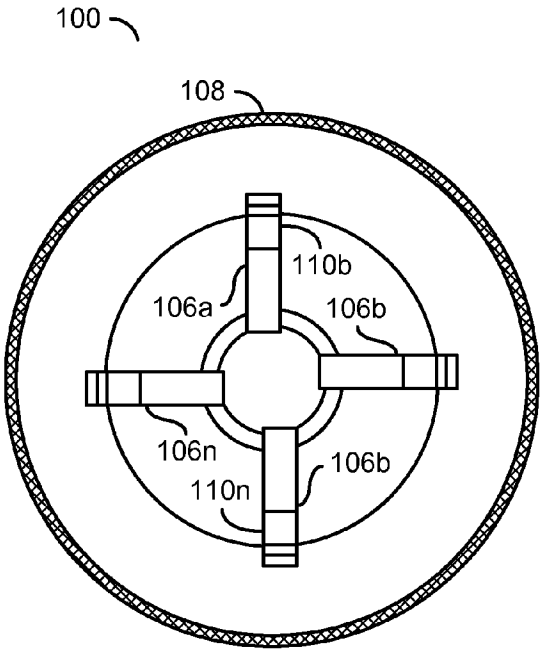
FIG. 4 is a diagram of a top view of an LED bulb.

Referring to FIG. 4, a diagram of a top view of the bulb 100 is shown. The elements (or thermal mounts) 106*a*-106*n* are shown approximately evenly spaced about the bulb 100.

However, the thermal mount 106*a* and the thermal mount 106*c* have a slight offset. Similarly, the thermal mount 106*b* and the thermal mount 106*n* have a slight offset. The offset is used so that one element of the elements 106*a*-106*n* does not block the light created by another one of the elements 106*a*-106*n*. The offset of the thermal mount 106*a* and the thermal mount 106*n* are shown along with the light dispersion from the bulb 100.

Figure 5:
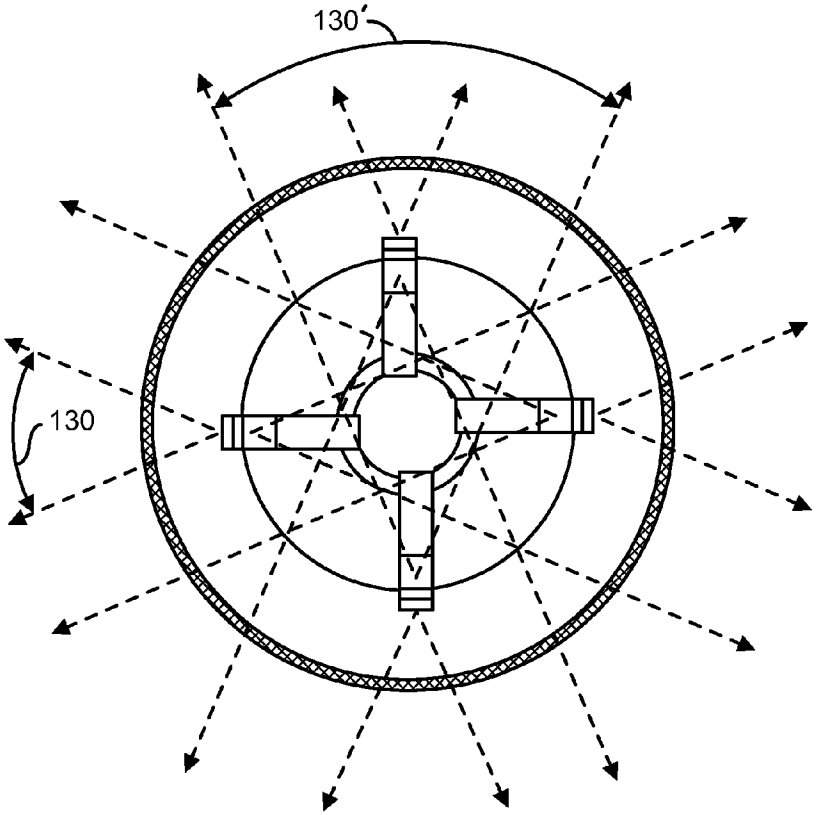
FIG. 5 is a top view of an LED bulb showing a light distribution pattern of the individual elements of FIG. 4.
Figure 6A:
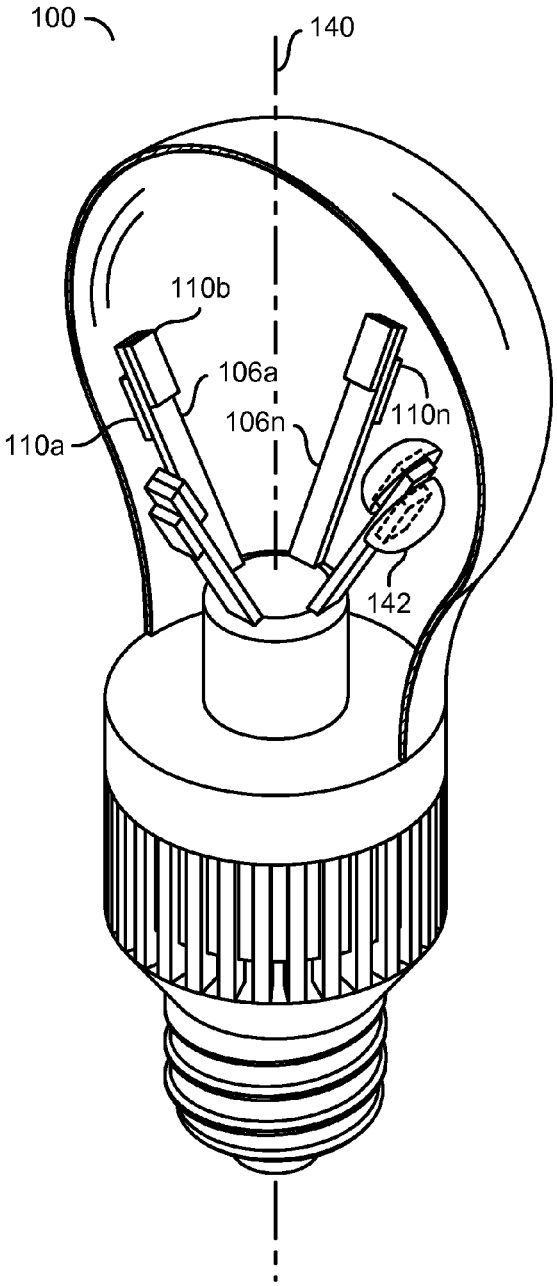
FIGS. 6A and 6B are perspective cutaway views of the LED lightbulb of FIG. 1.
Figure 6B:
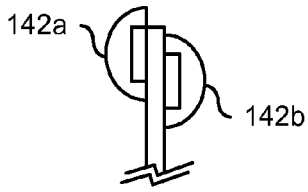

Referring to FIG. 5, a diagram of a top view of the bulb 100 is shown. The various LED elements 110*a*-110*n* are shown having the angle 130. Referring to FIG. 6A, a diagram of the bulb 100 showing a perspective cutaway view is shown. FIG. 6A shows an axis 140 and a lens 142. FIG. 6B shows a detailed view of the lens 142 illustrating a first lens portion 142*a* and a second lens portion 142*b*.

Figure 7:
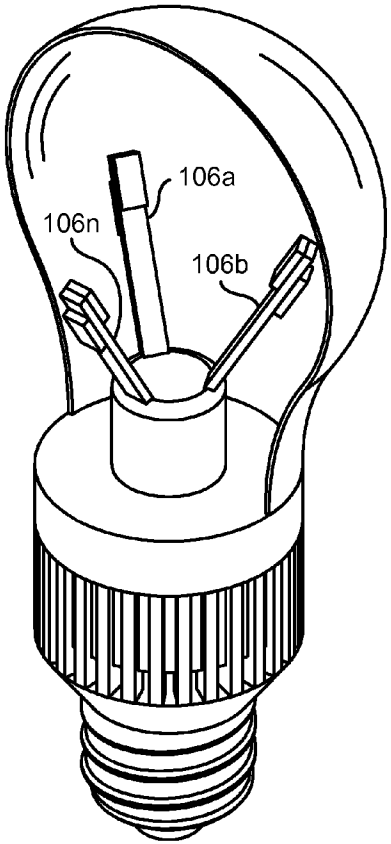
FIG. 7 is a cutaway view of an LED lightbulb illustrating an alternate LED placement.

Referring to FIG. 7, a diagram of an alternate implementation of the bulb 100' is shown in a perspective cutaway view. The number of thermal mounts 106*a*-106*n* is shown reduced from four to three. With an implementation of three of the thermal mounts 106*a*-106*n*, the light from one of the LEDs 110*a*-110*n* may pass through the gap between light from another of the LEDs 110*a*-110*n*.

Figure 9:
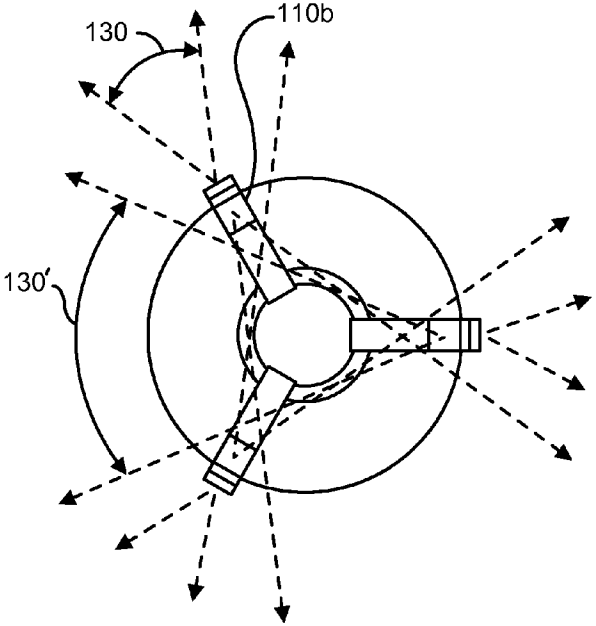
FIG. 9 is a top view of the bulb of FIG. 7.
Figure 8:
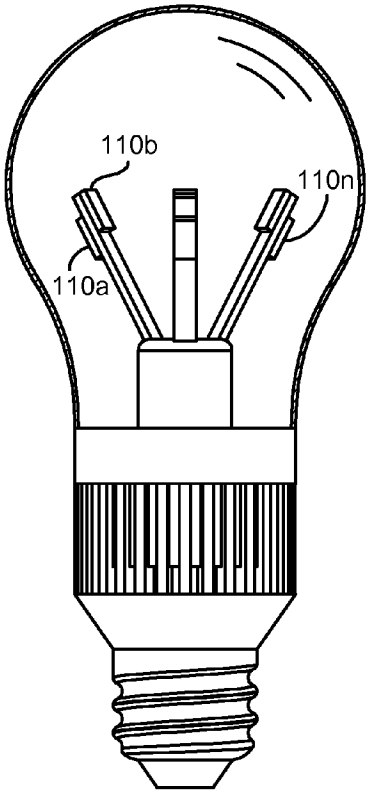
FIG. 8 is a side view of the bulb of FIG. 7.
Figure 10:
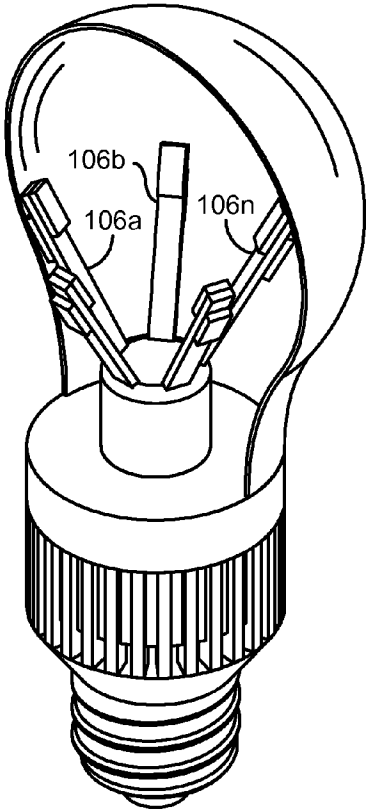
FIG. 10 is a cutaway view of an LED lightbulb illustrating an alternate LED placement.

Referring to FIG. 8, a diagram of a side view of the bulb 100' is shown. Referring to FIG. 9, a diagram of a top view of the bulb 100' is shown. Referring to FIG. 10, a diagram of a bulb 100" showing five thermal mounts 106*a*-106*n* is shown.

Figure 12:
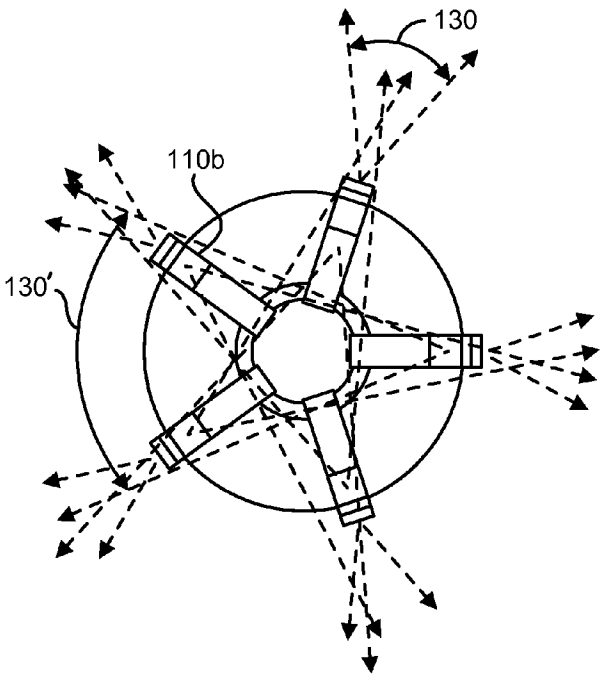
FIG. 12 is a top view of the bulb of FIG. 10.
Figure 11:
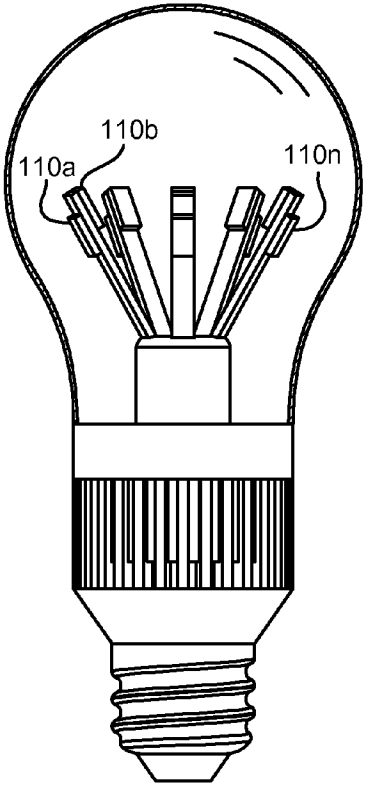
FIG. 11 is a side view of the bulb of FIG. 10.
Figures 13, 14, 14A, 15:
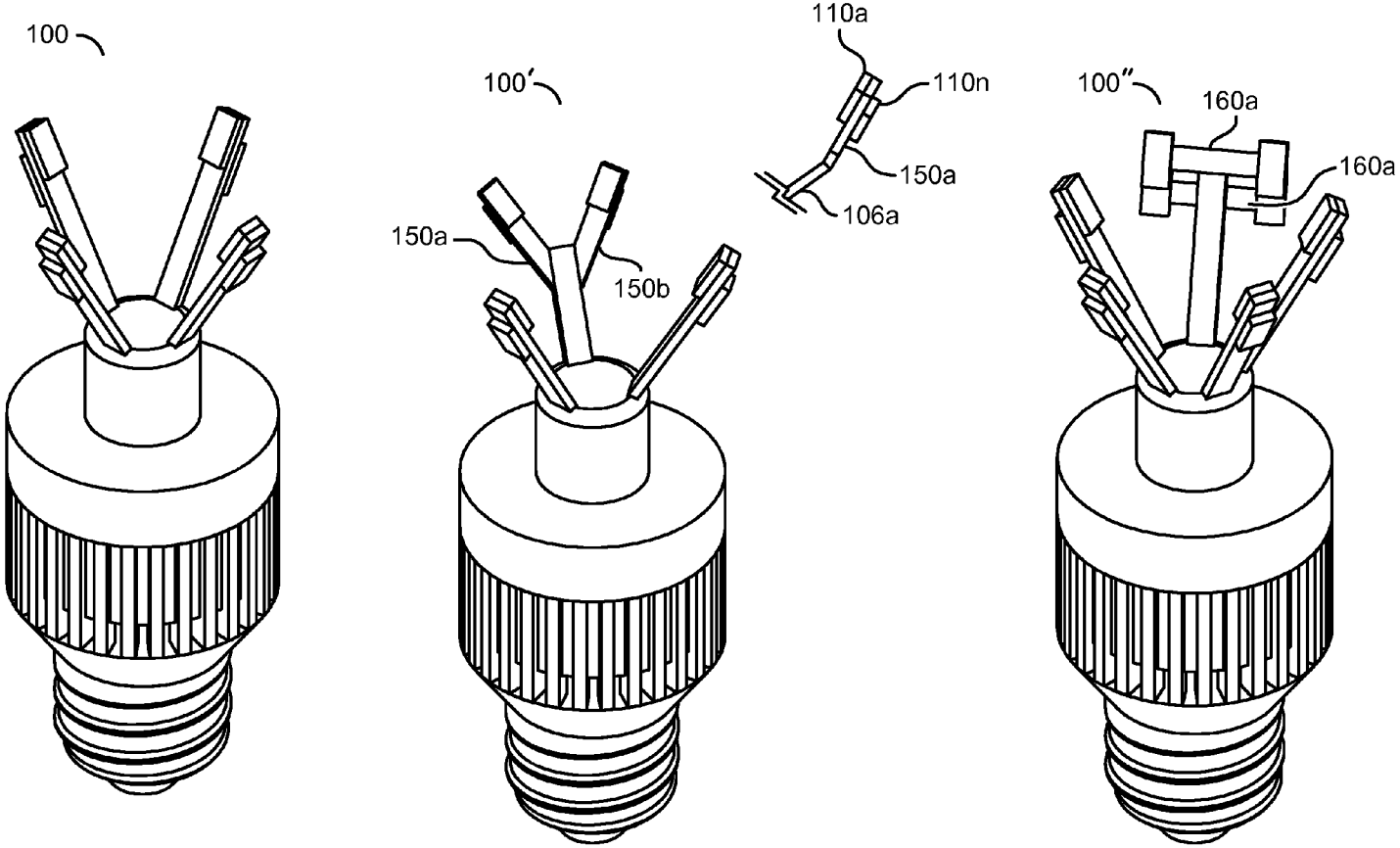
FIG. 13 is an exposed view of another alternate placement of the LED elements.
FIG. 14 is an exposed view of another alternate placement of the LED elements.
FIG. 14A is a cross section of a portion of the area of FIG. 14.
FIG. 15 is an exposed view of another alternate placement of the LED elements.

Referring to FIG. 11, a diagram of a side view of the bulb 100" is shown. Referring to FIG. 12, a diagram of a top view of the bulb 100" is shown. Referring to FIG. 13, an exposed diagram of the bulb 100 is shown. FIG. 13 shows a 4 mount example that may provide in the range of 275-325 lumens (the light output equivalent to a traditional 40 W bulb) with around 4 Watts of power consumption.

Referring to FIG. 14, an exposed diagram of the bulb 100' is shown. FIG. 14 shows a 3 mount example that may provide in the range of 210-240 lumens (the light output equivalent to a traditional 30 W bulb). The bulb 100' may have around 3 Watts of power consumption.

Referring to FIG. 15, an exposed diagram of the bulb 100" is shown. FIG. 15 shows a 5 mount example that may provide 375-400 lumens (the light output equivalent to a traditional 50 W bulb). The bulb 100" may have around 5 Watts of power consumption.

The bulb 100 may take a heritage (e.g., the look and feel) from a classic incandescent bulb. For example, from the outside, the bulb 100 may look like a bulb first developed by Edison. While conventional incandescent bulbs use a tungsten wire as the light source, modern LED lights use semiconductors for the light source, powered by voltages created in an integral power supply. Without the bulb 100, LED implementations have mounted a number of LEDs flat on a substrate base or on a vertical tower with multiple LEDS. Such implementations have had limited success in emulating the light output, angle, brightness, shadowing, light cast and/or look of a classic light bulb.

The bulb 100 may emulate the look and feel of an original incandescent light bulb. The bulb 100 may improve current techniques for generating an efficient light source while still providing the lighting experience a customer desires.

The bulb 100 may mount the LED semiconductors (e.g., light generating sources) 110*a*-110*n* on individual vertically positioned heat conducting metal mounts 106*a*-106*n*. The mounts 106*a*-106*n* may be angled to provide the light cast and/or look and feel of a conventional light bulb. The mounts are integrally implemented with the internal metal alloy core that may act as the internal heat sink. Heat may be drawn from the LEDs through the mounts 106*a*-106*n* through the core 104 to the outer finned base 120. The cooling holes 122*a*-122*n* may provide air flow.

The vertical mounts 106*a*-106*n* for the LED devices 110*a*-110*n* are normally offset to project light in an upward and/or downward angle at each mount of the mounts 106*a*-106*n*. The number of mounts 106*a*-106*n* in each bulb 100 may determine the wattage and/or amount of lumens projected by the bulb 100.

In one example, each of the vertical mounts 106*a*-106*n* may have two of the LEDs 110*a*-110*n* placed on the exterior and/or anterior sides of the mount 106*a*-106*n*. In one example, each of the LEDs 110*a*-110*n* may project 0.5 W. The offset of the mounts 106*a*-106*n* may provide an improved and/or more even horizontal (e.g., planar) light distribution.

The vertical mounts 106*a*-106*n* may be centered on the core base that may raise the height of the LEDs 110*a*-110*n* and/or create a centered light distribution, closer in performance to incandescent lighting. The mounts 106*a*-106*n* may be angled for even light distribution, with each of the vertical mounts 106*a*-106*n* being mounted at an angle between 10-30 degrees to best provide the desired light angle projection. Such an implementation may be based on the particular model and/or application of the bulb (e.g., candle, small bulb (45-50 mm) or normal sized bulb (60 mm). The internal heat sink 104 may enable cooling and/or heat removal. A centered core may form the basis of the internal heat sink 104 that may be used to draw heat out from the bulb 100. The heat may be drawn from the finned and/or vented base 120.

The bulb 100 may provide a lighting experience similar to incandescent light due to the location of the mounts 106*a*-106*n* and/or the height and/or the angles, and/or the use of the LEDs 110*a*-110*n* as the light source. An 80% savings (or more) in electrical consumption may result.

The bulb 100 may be compatible with light output up to 800 lumens (or more). In one example, a form factor may be similar to common incandescent bulbs, with cost saving energy efficient, green. LED lighting. For example, the elevated vertically mounted LEDs 110*a*-110*n* may be angled to provide an upward and/or downward light beam angle with offset LEDs 110*a*-110*n*. Such a placement may ensure a full 290 degree light casting from the top to the base of the bulb 100. The internally mounted core and the heat sink 104 may draw out heat from the LEDs 110*a*-110*n*. Such an arrangement may obviate the common large "ice cream cone" looking LED lights on the market today. The heat sink 104 provides a unique design with venting to enhance the life of the LEDs 110*a*-110*n*. The finned metal base 120 may include the heat vents 122*a*-122*n* for enhanced cooling and/or to provide an updated design and/or to provide internal cooling (e.g., like a passive fan) for designs with light output above 500 lumens. A driver chip may be mounted internally to the vented finned base 120. Such a driver chip does not need a power supply in the light bulb 100.

The bulb 100 may do away with power wasting costly power supplies in the bulbs. The center mounted heat sink (or slug) 104 may be expanded to make a honey-comb interior 120 to maximize the heat sinking and/or to keep the bulb 100 cooler and/or to provide a longer lasting bulb 100.

The bulb 100 may be implemented in an array of configurations (e.g., with 3 fingers, 4 fingers, 5 fingers, or even more fingers). The fingers may be evenly spaced and/or may use the angle of both the fingers, plus the light angle of the LEDs 110*a*-110*n* to provide full coverage and/or to form the light cast and/or to form the light beam. Tests show a variety of desired coverages that may be achieved with such configurations.

The fingers 106*a*-106*n* may be off-set from the center of the bulb 100 so the LEDS 110*a*-110*n* and/or the fingers 106*a*-106*n* have some projection space. An odd number of the fingers 106*a*-106*n* may provide a natural "groove" in the opposite side spacing. An even number of the fingers 106*a*-106*n* may be implemented. In such a configuration, the fingers may be offset by half a finger width from the center slot.

The 30 degree angle of the fingers 106*a*-106*n*, plus the 145+ degree light angle output of the LEDs 110*a*-110*n* project light to cover the desired full light casting. In one example, an inner one of the LEDs 110*a*-110*n* may be placed higher on one of the fingers 106*a*-106*n* than the LEDs 110*a*-110*n* placed on the outer (e.g., by half of the height of one of the LEDs 110*a*-110*n*).

While a number of examples have been shown, other designs may be implemented. For example, a number of LEDs 110*a*-110*n* on the fingers 106*a*-106*n* may be implemented. In another example, a number of the LEDs 110*a*-110*n* may be in a ring. In one example, the base 120 may be increased to accommodate a higher wattage equivalent output. The base 120 may be designed to extract heat from the bulb 100. For example, a "Y" shaped finger (shown in FIG. 14) or a "T" shaped finger (shown in FIG. 15) may be implemented with multiple LEDs 110*a*-110*n* on each of the fingers 106*a*-106*n*. In such an example, enough LEDs 110*a*-110*n* may be used to give the light bulb 100 a "feel".

In one example, the bulb 100 may also be used with dimmer controls. A dimmer control may use a driver/power supply design that is different than a non-dimmable bulb. While dimmer power supply may be more expensive, many customers desire an implementation of the bulb 100 that is dimmable.

The bulb 100 may have a number of dimmer capable implementations. For example, the LEDs 110*a*-110*n* typically work at voltages around 24 VDC. The challenge is to define the match between dimmer technology and the threshold avalanche voltage of the individual LEDs 110*a*-110*n*. In some digital controllers, such a match may be difficult but may still be possible with a control circuit. In general, a digital controller does not act the same as a mechanical controller found in most older home and industrial systems.

An avalanche typically takes place somewhere around 11-15 V, depending on the particular type of the LEDs 110*a*-110*n* implemented. For some digital controllers, a match between the supply/driver design and/or the controller may be implemented to target the 11-15V range. In one example, a complete control system may be implemented on a package within the bulb 100.

The LED elements 110*a*-110*n* may present around 150 degrees of light dispersion, with the normal dispersion being 145 degrees. An ideal projection angle may be 150 degrees. The 50% point may be 75 degrees, with a finger offset of 30 degrees. Mathematically, using 145 degrees may be an ideal point to target in a particular design. By implementing the height of the finger elements 106*a*-106*n* to be taller (e.g., longer), a more targeted downward projection angle may be achieved. The "top of the globe" projections may change and consideration may be taken to avoid black spots when taking production variances into account.

The bulb 100 may ideally radiate 360 degrees in the plane normal to the axis of rotation 140. The light from the horizontal axis 140 will normally be 360 degrees of light projection. The light from the vertical axis will exceed 290 degrees of light projection. The angle of one of the fingers 106*a*-106*n*, is to ideally form a 35 degree angle (e.g., 30-40 degrees). The angle of light from the LED device is 145 degrees (e.g., 140-150 degrees). Mathematically, the angle of light from the vertical axis should be around 30+145=175 degrees. 175 degrees approaches the theoretical maximum of 180 degrees from the vertical axis. Used in a vertically mounted upward facing lamp, the bulb 100 will normally emulate the light dispersion and/or projection of a historical incandescent bulb. Depending on the particular installation, the bulb 100 may even project a downward shadow of the lamp onto a desk or table. Used in a downward facing direction, the bulb 100 will radiate a full 360 degrees on the horizontal plane and/or upward to the ceiling (e.g., to get a reflection) similar to the effect of an incandescent type bulb.

The housing 108 may be clear or frosted glass or plastic. One implementation of the housing (or globe) 108 may be to use certified tempered glass. Frosted and/or clear materials for the housing 108 may be implemented based on market demand. A frosted globe 108 may cut down the output of lumens (e.g., by 10%). Plastic historically has discolored with age. Even though the bulb 100 generates an insignificant amount of UV light radiation (which would eventually yellow plastic), plastics do output gas and may age with time. In one implementation, alternative long term aging plastics may be used. The bulb 100 may incorporate plastic (as market demands) for a more "safety" feel as opposed to glass. Cost may drive the direction of production bulbs 100 to plastic. The bulb 100 is anticipated to last for 25,000-35,000 hours in a normal environment (e.g., 6 hours/day=12-15 years of operation; 24 hours/day=4-5 years+). Such long life spans may eventually show discoloration if plastic is used for the globe 108.

Since the LEDs 110*a*-110*n* do not oxidize, a gas may help remove the heat. The bulb 100 is not normally hermetically sealed (as needed to in current CFL and/or historical incandescent light bulbs). These types of bulbs use a "gas" and a hermetic seal to preserve the effects of the gas which protects the filament from oxidation. A CFL bulb holds in the gas which is energized by the electrons to generate light. The LED bulb 100 does not normally need a hermetic "seal", just a moisture and/or dust proof seal of the attachment of the globe 108 to the base 120 of the bulb 100. Mounted in a dry air manufacturing environment is normally preferred for longevity. In general, the LED devices 110*a*-110*n* may be manufactured to be moisture resistant. The seal is used to maintain the integrity of the design and/or to prevent tampering.

The finned base 120 may be used to dissipate heat. In one example, a low power (e.g., 3 W) design may be implemented without fins to dissipate the heat. Multiple approaches to the design of the bulb 100 may be used to balance the heat dissipation, safety, cost and/or aesthetics of the design. A 3 W design without fins may be used in candle type bulbs and/or in small base bulbs (e.g., E12/E14). Designs with a large globe 108 will more easily dissipate heat and/or result in a base temperature of less than 60 C. Such a design will normally pass the UL/ETL specification of 70 C. A 3 W, 4 W and/or 5 W design with an E26/E27 base (e.g., standard base) may need the fins and/or may use a larger design of the base 120 for each power level. In general, the bulb 100 may maintain the aesthetic look wherever possible to present the look and feel of a "historical" incandescent light bulb design. These designs include internal thermal heat extractors to draw heat to the center barrel 104 of the base 120 and out through the fins 122*a*-122*n*. Heat extraction techniques may be used to produce products that achieve 7 W to 10 W of LED light output (e.g., 550-850 lumens).

The 4 LEDs 110*a*-110*n* shown in FIG. 3 appear to illuminate over 4×45 degrees=180 degrees in a plane containing the axis of rotation. This is the same issue with the plane normal to the axis of rotation 140. A 145 degree angle may be an average (e.g., a 140-150 degree angle of light output may be implemented) for each of the LED devices 110*a*-110*n* used in design. Certain LED devices 110*a*-110*n* may have up to a 160 degree angle of light output.

Light is also generally directed straight out of the top of the bulb 100. A hanging light fixture over the kitchen table may be implemented with each of the LEDs 110*a*-110*n* being implemented as multiple LEDs 110*a*-110*n*, each pointed in a slightly different direction. One of the LEDs 110*a*-110*n* may be mounted on the heat sink 104 pointing straight along the axis of rotation. The angle of light per chamber normally matches the light projection of an incandescent light bulb. The LED bulb 100, due to the height of the LED mounts 110*a*-110*n* on the pedestal 104 (e.g., part of the heat sink 120 internal to the bulb 100) together with the angle of the finger mounts 106*a*-106*n*, may provide a bright and/or even distribution of light at the "top" of the bulb 100.

One of the LEDs 110*a*-110*n* may be used in the center of the light base as needed. In general, such a center mount of one of the LEDs 110*a*-110*n* may or may not be needed. A center mount of one of the LEDs 110*a*-110*n* does not tend to provide as even a light distribution as the multiple mount approach. A center reflector may be used in higher wattage designs to maximize use of the inside downward projecting light in the higher wattage lights. The reflector design is center mounted, with multiple facets to project light upward. Such a reflector may be made from a material that is a polished and/or plated metal. Other highly reflective materials, such as plated plastics (e.g., no heating issues) may be used.

In "tulip" base hi-tech look designs (which use state of the art thermo-plastics) all of the LEDs 110*a*-110*n* are mounted on the horizontal plane inside the light. This approach creates a downward (or upward) light projection depending on the light fixture, with some pixeling due to the number of small LEDs 110*a*-110*n* used. Minute black spaces between each of the LEDs 110*a*-110*n* may be felt at a distance from the bulb 100. A "tulip" design approach may reduce both the black spacing by the use of an advanced brighter device and/or spacing approach. Heating issues may be reduced and/or minimized by implementing a thermo-plastic base design (integrating some metal of the finned base 120 into the thermo-plastic housing) to make the bulb 100 even safer. In one example, PFT plastic may be implemented for the housing.

The bulb 100 may be assembled in a variety of ways. The thermal mounts 106*a*-106*n* may extend a larger radial distance than the narrow end of the housing 108 where the housing 108 is connected to the finned base 120. The LED mounting elements 106*a*-106*n* are not generally flexible unto themselves, but may be flexible in certain designs. Implementing the fingers 106*a*-106*n* in a rigid fashion may help to reduce manufacturing costs. The positioning of the fingers 106*a*-106*n* is generally fixed by design. The fingers 106*a*-106*n* may be configured to extend beyond the radius of the heat sink 104, but not to the radius of the finned base 120 (e.g., where the globe 108 mounts to the base). The fingers 106*a*-106*n* may include a metal piece that is a sandwich of a PCB (for electrical connection) between two metal tabs or the fingers 106*a*-106*n*. Designs with higher power specifications may incorporate a larger diameter for the base 120 commensurate with the diameter of the heat sink 104. Such an implementation may provide a greater amount of heat dissipation and/or heat "evaporation" away from the LEDs 110*a*-110*n*.

An integrated power supply may have a variety of implementations. For example, the bulb 100 may have a customized internal power supply referred to as a "driver". Such a power supply may be connected in parallel to the LEDs 110*a*-110*n*. In a T-8 tube replacement example, the power supply may be a series-parallel configuration. If one of the LEDs 110*a*-110*n* fails, the bulb 100 will continue to operate (although there will typically be a loss of light in the direction in which the failed one of the LEDs 110*a*-110*n* is mounted). To avoid such a reduction in light output, a new series of highly reliable higher output (e.g., 0.5 W) LEDs 110*a*-110*n* may be used. The number of lumens per watt and/or assembly costs may be improved over a typical 18-24 0.1 W LED element.

The 10 to 30 degree angle of the thermal mounts 106*a*-106*n* is normally measured relative to the axis of rotation of the bulb 100. The 30-35 degree positioning of the fingers 106*a*-106*n* is relative to the vertical axis of the light bulb 100. For example, a straight line drawn from the screw mount, through the finned base 120 and/or pedestal mount through the virtual top of the light globe is shown in FIG. 6 as element 140.

Various alternatives for implementing the bulb 100 may be implemented. For example, the lens 142 (or the lens 142*a* and/or 142*b*) may be incorporated over each of the LEDs 110*a*-110*n* to enhance the angle of coverage. Most narrow angle power LEDs 110*a*-110*n* use a lens to achieve the angle. The lenses 142*a* and/or 142*b* tend to discolor over time. To avoid a change in the color of the light, a pre-discolored lens may be used. For example, a yellow shade may be used to emulate the 3000K "soft white" temperature range. Other lenses may be implemented. Embodiments addressing higher lumen output that use multiple LEDs 110*a*-110*n* on each of the finger mounts 106*a*-106*n* may be implemented. For example, T-finger (of FIG. 15) where there are mounted multiple LEDs 110*a*-110*n* to an outward direction and single inward and upward. Another example may be Flying Y-finger (of FIG. 14A) where angled Y provides better light projection angles. For example, an angle between the thermal mounts 150*a*-150*b* and the thermal mount 106*a* may be implemented.

Another alternative may include variations of the design of the heat sink 104. Improvements on heat channeling from LEDs 110*a*-110*n* mounted to the elements 106*a*-106*n* through the base 120 may be implemented. Use of alternates may be used for improved performance for designs (e.g., up to 1,000 lumens and/or 7-12 W). Use of thermo-plastics on base power designs below 7 W may also be used. One approach to the heat sink 104 may be using a honeycomb matrix flowing into a critically thin area to force heat evaporation. Another approach may be to use newer thermal-plastics. Such plastics may be melted in the heat mass to the thermal-plastics with thin fins.

The LED light bulb 100 may be inherently greener than current CFL bulbs. The LED light bulb 100 contains no mercury (as in CFL—compact florescent lights). The LED bulb 100 does not use any type of inert and/or otherwise environmentally unfriendly gas. The bulb 100 may last over a generation and so will therefore contribute minimally to landfill issues for the next 20-25 years. LEDs typically use 30% less electricity than CFLs or roughly only 12% of an incandescent bulb.

In one example, the bulb 100 may be implemented without a power supply. A designed driver "chip" may replace the power supply. When used in T-8 florescent replacement tubes, better thermals, and/or longer life of products may result.

The invention claimed is:

1. An apparatus comprising:

a base configured to attach to a screw in light socket;

a heat sink connected to said base;

a plurality of thermal mounts projecting from said heat sink, wherein said thermal mounts are electrically connected to said base and thermally connected to said heat sink; and at least two LED elements connected to each of said thermal mounts, wherein (A) one of said LED elements comprises an inner LED element aimed in a first direction and one of said LED elements comprises an outer LED element aimed in a second direction, (B) said LED elements form a pattern about a central axis to project light evenly from said apparatus and (C) each of said inner LED elements projects light towards said central axis and each of said outer LED elements projects light away from said central axis.

2. The apparatus according to claim 1, wherein said LED elements are configured to project light evenly from said apparatus in a 290 degree radius.

3. The apparatus according to claim 1, wherein two or more of said LED elements are connected to a first side of said thermal mount and one of said LED elements is connected to a second side of said thermal mount.

4. The apparatus according to claim 1, wherein two or more of said inner LED elements are connected to a first side of said thermal mount, and two or more of said outer LED elements are connected to a second side of said thermal mount.

5. The apparatus according to claim 1, wherein said thermal mounts project from said heat sink at an angle between 10 and 30 degrees.

6. The apparatus according to claim 1, wherein one or more of said thermal mounts has a "Y" shape configured to hold at least one of said inner LED elements and at least one of said outer LED elements on a first branch and at least one of said inner LED elements and at least one of said outer LED elements on a second branch.

7. The apparatus according to claim 6, wherein said first branch and said second branch have an angle with respect to a base of said thermal mount.

8. The apparatus according to claim 1, wherein one or more of said thermal mounts has a "T" shape configured to hold at least one of said inner LED elements and at least one of said outer LED elements on a first branch and at least one of said inner LED elements and at least one of said outer LED elements on a second branch.

9. The apparatus according to claim 1, wherein a width of said thermal mounts is equal to a width of said LED elements.

10. The apparatus according to claim 1, wherein said inner LED element is configured to project light through a space between said thermal mounts on an opposite side of said apparatus and said outer LED element is configured to project light at a downward angle from said thermal mounts.

11. The apparatus according to claim 10, wherein an offset arrangement of said thermal mounts is implemented to create said space between said thermal mounts.

12. The apparatus according to claim 1, wherein said inner LED elements are higher than said outer LED elements on said thermal mounts.

13. The apparatus according to claim 1, wherein said apparatus is dimmable.

* * * * *